US007559687B2

(12) United States Patent
Swisher

(10) Patent No.: US 7,559,687 B2
(45) Date of Patent: Jul. 14, 2009

(54) MORTAR MIXING DRUM ASSEMBLY

(75) Inventor: James A. Swisher, Jacksonville, FL (US)

(73) Assignee: Stone Construction Equipment, Inc., Honeoye, NY (US)

( * ) Notice: Subject to any disclaimer, the term of this patent is extended or adjusted under 35 U.S.C. 154(b) by 0 days.

(21) Appl. No.: 11/589,359

(22) Filed: Oct. 30, 2006

(65) Prior Publication Data

US 2008/0101153 A1 May 1, 2008

(51) Int. Cl.
*B28C 5/14* (2006.01)

(52) U.S. Cl. ..... 366/47; 366/64

(58) Field of Classification Search ..... 366/45–48, 366/64–67, 185, 309–313, 606
See application file for complete search history.

(56) References Cited

U.S. PATENT DOCUMENTS

| | | | | | |
|---|---|---|---|---|---|
| 2,499,052 | A * | 2/1950 | Brookins | ..... | 366/47 |
| 3,931,748 | A * | 1/1976 | Tertinek et al. | ..... | 74/606 R |
| 4,043,540 | A * | 8/1977 | Stone | ..... | 366/222 |
| 4,478,515 | A * | 10/1984 | Tobin | ..... | 366/67 |
| 4,877,327 | A * | 10/1989 | Whiteman, Jr. | ..... | 366/46 |
| RE34,505 | E * | 1/1994 | Whiteman, Jr. | ..... | 366/46 |
| 5,441,341 | A * | 8/1995 | Halsted | ..... | 366/47 |
| 6,695,467 | B1 * | 2/2004 | Montag | ..... | 366/47 |
| 7,128,462 | B2 * | 10/2006 | Swisher | ..... | 366/47 |
| 2005/0195682 | A1 * | 9/2005 | Swisher | ..... | 366/47 |

FOREIGN PATENT DOCUMENTS

EP 1528182 A2 * 5/2005

* cited by examiner

*Primary Examiner*—Charles E Cooley
(74) *Attorney, Agent, or Firm*—Jacobson Holman PLLC

(57) ABSTRACT

The assembly includes frame, drum having a substantially cylindrical body with upper outlet opening covered by a grate. The drum includes a laterally disposed discharge chute and a back wall. A shaft mounted between end walls and carries a pair of arms with a center paddle and V-shaped mixing paddles are on respective arms for increasing the amount of entrained air in mixed mortar. The back wall is inclined from the vertical by no more than 15° to inhibit build up of the mortar being mixed in the drum. A three member bag splitter is affixed to the grate over the widest area of the outlet opening. A two-section cab encloses an engine and allows for access to the starter and engine controls while protecting a user. A gear drive shield medially of the cab provides user protection and protects the drive components from dust and debris.

20 Claims, 5 Drawing Sheets

MORTAR MIXING DRUM ASSEMBLY

CROSS-REFERENCE TO RELATED APPLICATION

This application is related to an application entitled "CYLINDRICAL MIXING DRUM ASSEMBLY INCLUDING END WIPERS AND ENLARGED CHUTE," application Ser. No. 10/795,469, filed Mar. 8, 2004, by the present applicant, now issued as U.S. Pat. No. 7,128,462 B2.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to mortar mixing drum assemblies and particularly to improvements in the mixing apparatus and associated operational safety matters.

2. Relevant Art

Conventional mortar mixing apparatus includes a bag splitter located on a pivotally mounted grate on the drum over rotating mixing paddles. In addition, the engine used to rotate the paddles is enclosed in a cab that can be opened to start/stop the engine and closed, for safety purposes, when the engine is running. What is needed is a new drum configuration for better loading and mixing and safe operation of the assembly engine at the same time.

BRIEF SUMMARY OF THE INVENTION

In one aspect of the present invention there is provided a portable mixing drum assembly comprising a frame, a mixing drum having a lower hollow substantially cylindrical body with an upper enlarged outlet opening covered by a pivotally mounted grate, the drum including a pair of spaced end walls and a laterally disposed discharged chute of approximately 24 inches wide extending from the outlet opening and a back wall spaced away from the chute and integral with and extending upwardly from the body. A shaft is mounted medially between the end walls and carrying a pair of oppositely disposed arms each carrying a center paddle. An engine is mounted on the frame operatively connected to the shaft for rotating the shaft and starter operating controls located closely adjacent the engine for the safe operation thereof. The back wall of the body is inclined from the vertical by no more than 15° to inhibit build up of the mortar being mixed in the drum.

An additional pair of V-shaped mixing paddles is mounted on respective arms for increasing the amount of entrained air in mixed mortar. The arms are medially located on the shaft. Each of the additional paddles includes opposite end portions which are angled toward each other and toward the shaft for increasing air entrained in the mortar during mixing of the mortar. A bag splitter is affixed to the grate, including at least one vertically extending sharpened splitting member above the shaft for penetrating a bag carrying a mortar component to create an opening therein to cause the release of the contents thereof. Preferably, the splitter further includes a spaced pair of sharpened second splitting members on opposite sides of the first splitting member for increasing the size of the opening in a bag created by said at least one splitting member.

A cab mounted on the frame substantially encloses the engine; the cab includes a first section affixed to the frame, a second section movably attached to the first section and movable between a first portion covering the engine and a second position exposing a rearward portion of the engine, the second section includes a front open face and a rear face having an access opening in a lower portion thereof for access to the starter operating controls of the engine when the section of the cab is in the first position. The second section includes an exhaust vent to provide passages from the cab for exhaust from the engine. The discharge chute is located on one side of the assembly and the exhaust vent are located on another side. The rear face includes at least one vent above the access opening for directing engine exhaust rearwardly out of the cab. A two-part engine cab has a rear section pivotally attached to a fixed front section, the rear section includes a side engine exhaust vent, the rear section of the cab also including an enlarged opening for access to the starter operating controls of the engine.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE PRESENT INVENTION

Introduction

In some mixing drum designs the back lip of the drum is angled in a manner that provides a "shelf effect" that allows for accumulation of mortar along the back lip of the drum. The present mixing drum has a back lip that varies from the vertical by no more than 15°. This structure eliminates the "shelf effect" found in prior art drums.

Many drums incorporate a bag splitter mounted on the covering grate to allow for ease of loading the drum with mortar, sand, or an appropriate mix as desired. The present drum assembly incorporates three upwardly directed splitter peaks. The middle peak is taller than the other two to provide a target for a user in placing the bag on the center of one side of the bag by a user, and is located directly over the mixing paddle shaft. In addition, the bag splitter is positioned over the widest area of the drum opening or throat to split the bag in the optimum position.

The width of the pouring or discharge chute has also been increased to provide for more effective use of the newly designed back lip and splitter.

Generally, belt-driven mortar mixers use two-piece engine cabs that should be closed when the engine is running to protect the users from engine parts and gears. In reality, however, cabs are left open while the engine is running because access to the "rope pull start" apparatus and the start/stop switch have to be operated many times during a normal day.

The present assembly provides a two-piece cab that totally encloses the engine but for access to the rear of the engine and the operating controls of the engine when in normal use. In addition, the vent ports have been modified.

Finally, additional shaped paddles are mounted to the center paddle arms to improve the mixing of mortar therein.

Construction

Figure 1:
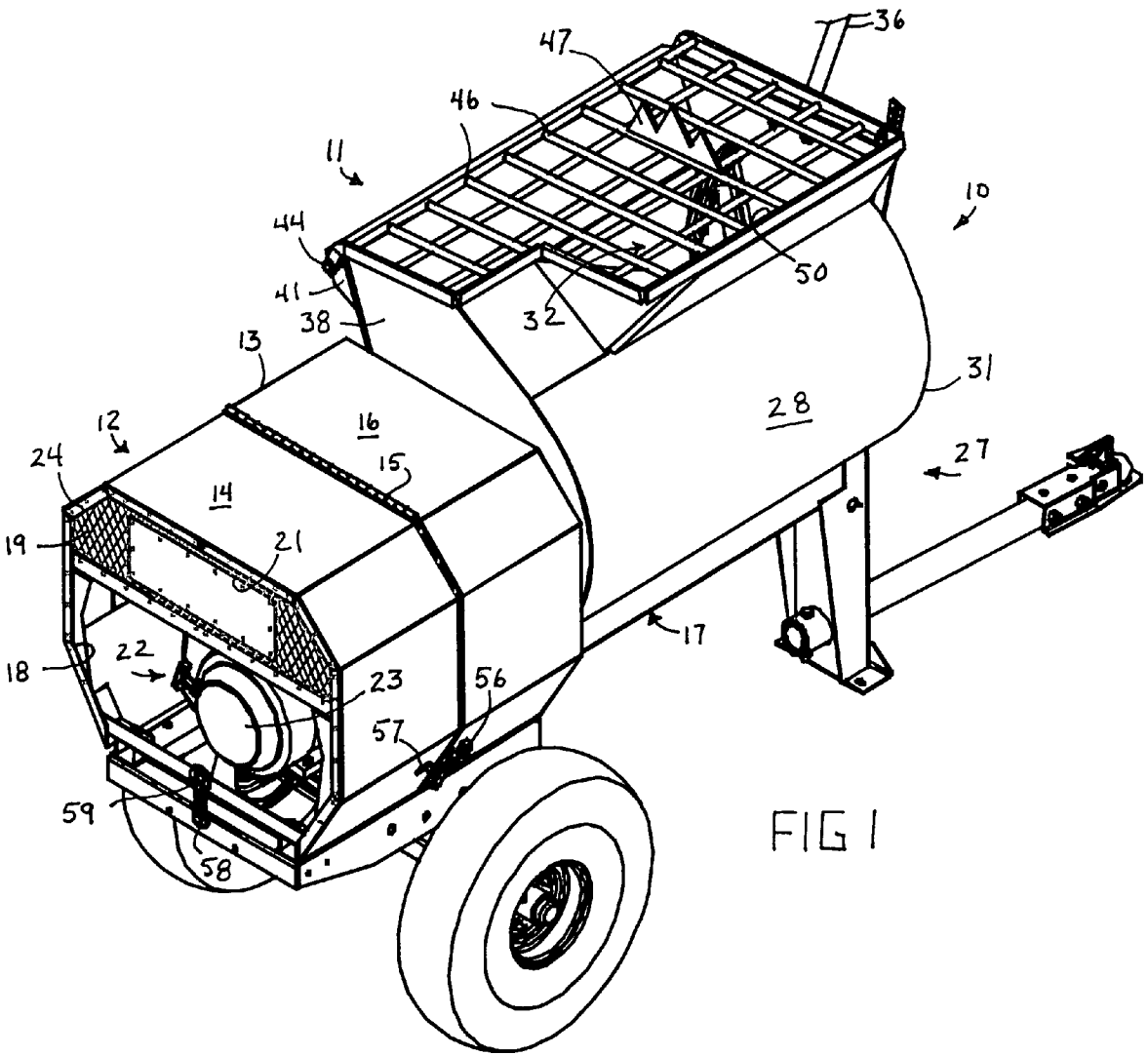
FIG. 1 is a perspective view of the improved mixing drum assembly in accord with the present invention showing the closed engine cab.
Figure 2:
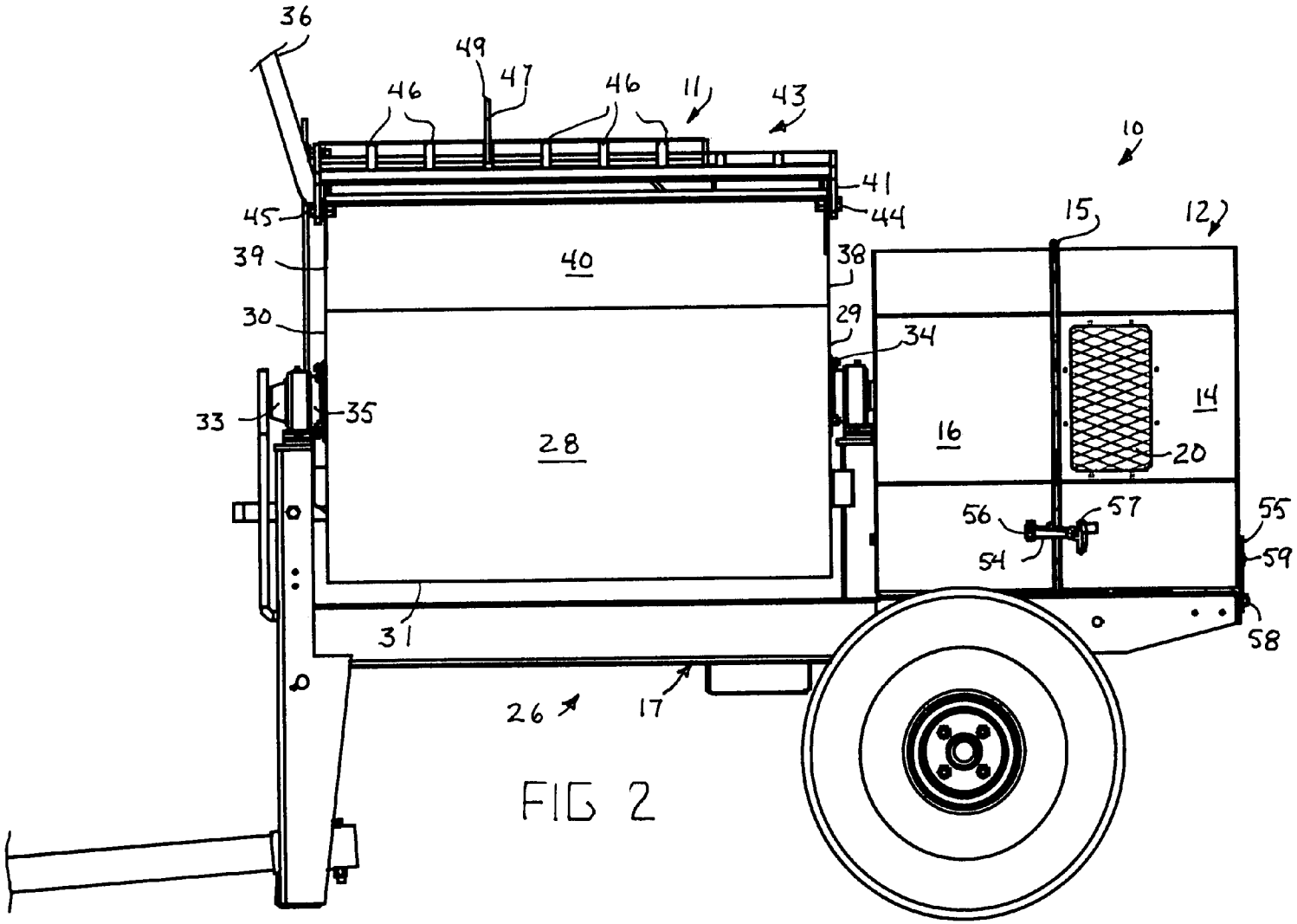
FIG. 2 is a left side elevation view of the assembly of FIG. 1.
Figure 3:
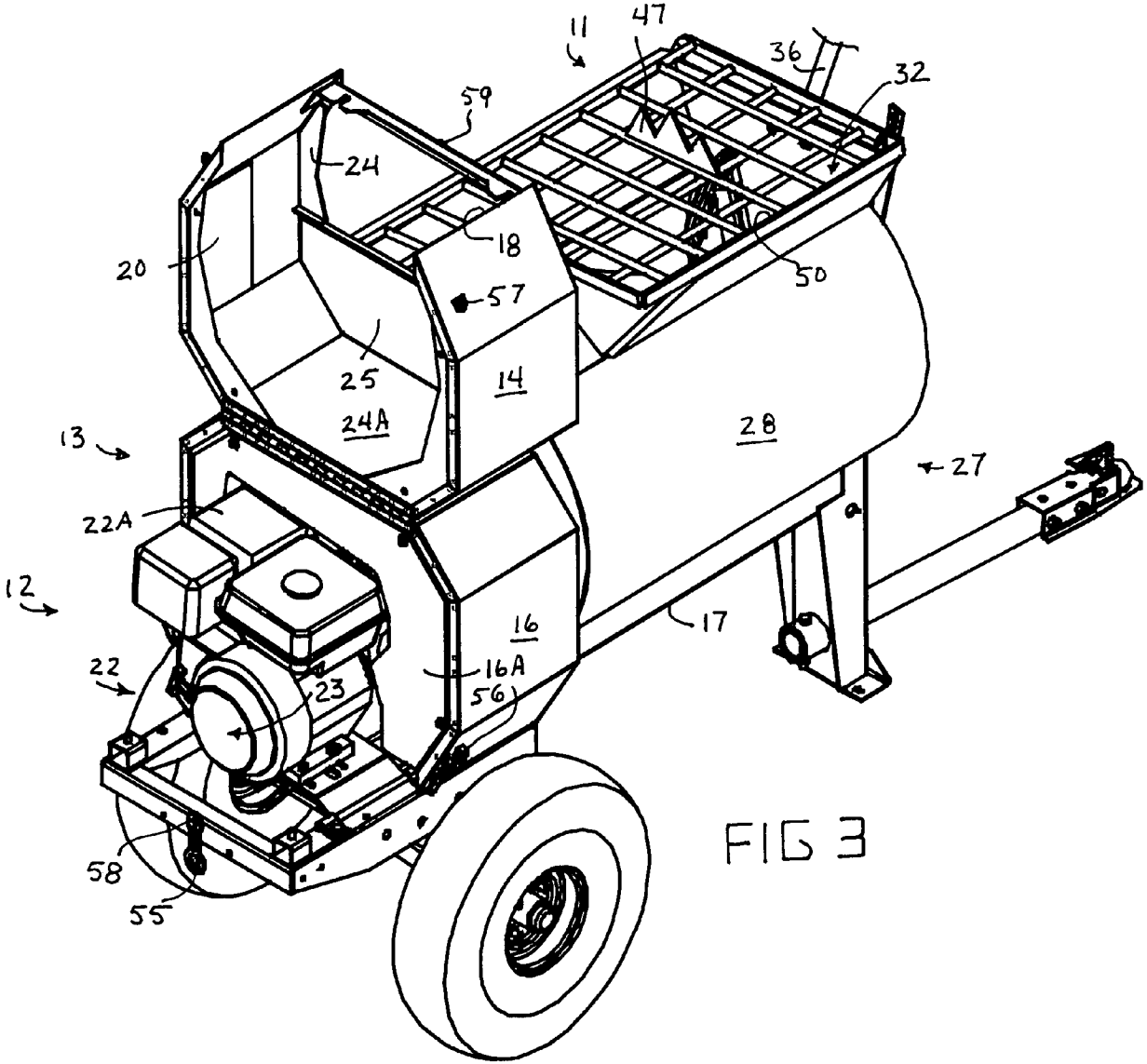
FIG. 3 is a perspective view of the assembly of FIG. 1 showing the engine cab in the open position.

With respect now to the drawings, FIGS. 1 and 2 illustrate the mixing drum assembly generally at numeral 10. The mixing drum is shown generally at 11 and is attached to a conventional engine 12 as understood in the art.

With respect also to FIGS. 34, engine cab 13 has two sections, rear section 14 that is pivotally mounted via hinge 15 at front face 20A to a fixed front section 16 including drive gear shield 16A mounted to front section 16 medially of cab 13 to provide the highest level of worker safety and to provide protection from dust and debris which extends the life of the drive components, from the engine to the paddle shaft. Rearward opening 18 provides access to the engine 22 which includes a "pull-to-start" apparatus 23 and other engine controls. Side vent port 20 provides an exit passage for air from muffler 22A of the engine 22. Air is also exhausted through vent ports 19 located in the rear face section 24 of cab section 20. A solid panel 25 may be used in place of opening 21. Furthermore, vent 20 faces the back side 26 of assembly 10 so as not to have engine exhaust blowing towards a user standing on the opposite front side 27.

Figure 7:
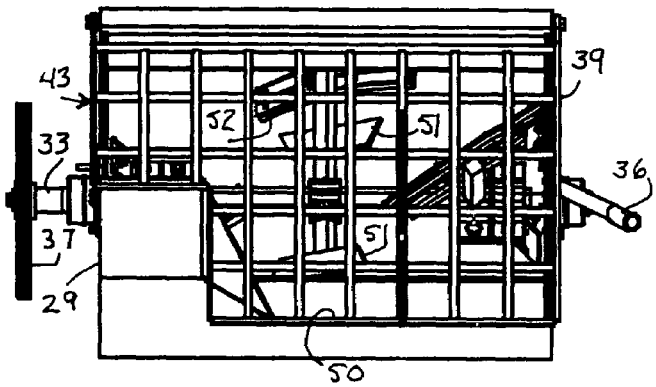
FIG. 7 is a top plan view of the mixing drum and center paddle assembly.
Figure 6:
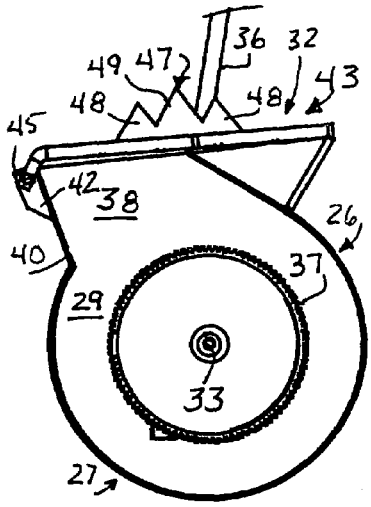
FIG. 6 is an end view of the mixing drum of FIG. 5.
Figure 5:
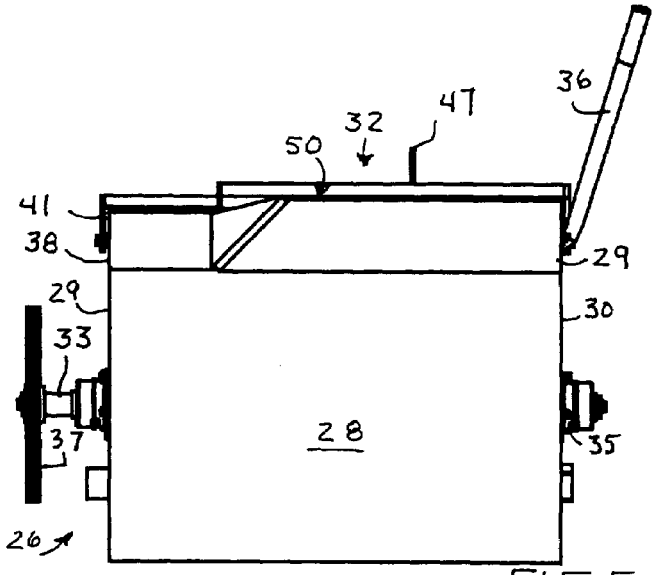
FIG. 5 is a side elevation view of the improved mixing drum of FIG. 1.

The mixing drum 11 is illustrated in more detail in FIGS. 5-7. Drum body 28 includes flat end walls 29, 30. A substantially cylindrical section 31 and an outlet discharge opening 32.

Paddle shaft 33 is mounted via conventional bearings 34, 35. Handle 36 is used to rotate or tilt the drum body 11. Engine 22, gearing 37 and other transmission and clutch apparatus is conventional as understood in the art.

Outlet opening 32 is formed by vertical end walls 38, 39 that are integral with respective end walls 29, 30. Back wall or lip portion 40 includes flanges 41 and 42 which are used for pivotally mounted cover grate 43 on pins 44, 45 (FIG. 5).

Grate 43 includes six bars 46 to which is mounted bag splitter 47 which includes two sharpened short peak members 48 and a sharpened taller peak member 49. Bag splitter 47 is mounted by bolting or welding on the third bar from the front of assembly 10 to position the splitter 47 over the widest portion of opening 32 to provide a target for a user.

Back wall 40 is inclined or angled to slant no more than 15°, preferably 5°-15°, from vertical axis 53 to eliminate the "shelf effect" that exists in drums with a back lip angled to a greater degree. Preferably, wall 40 is angled away from opening 32 at about 5°. The width of opening 32 has been increased to create a discharge chute 50 of approximately 24 inches from 15 inches in some earlier drums 11.

Figure 8:
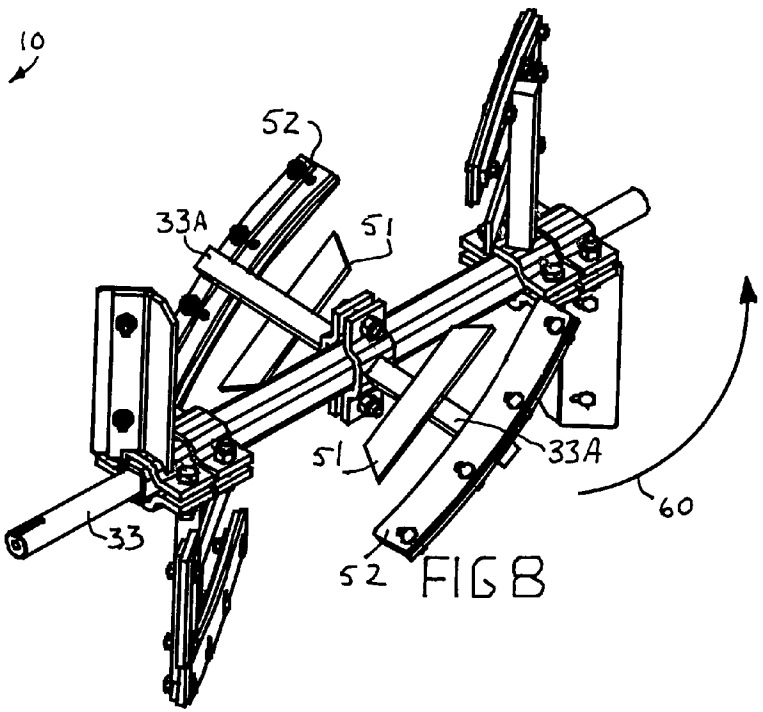
FIG. 8 is a perspective view of the paddle assembly of FIG.7.
Figure 4:
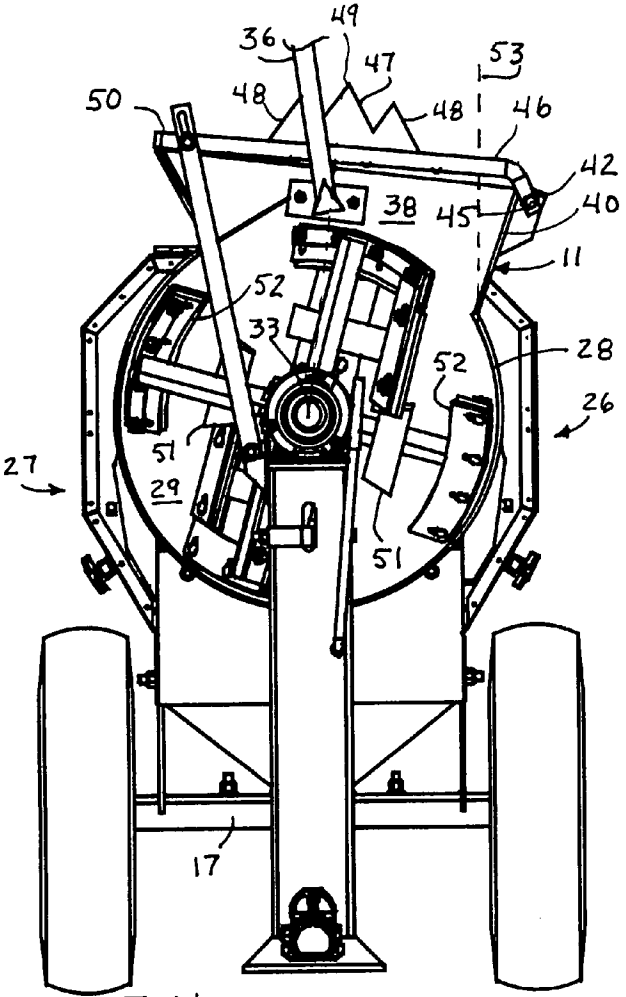
FIG. 4 is a cutaway end view of the drum of FIG. 1.

With regard to FIGS. 7, 8, additional shaped paddles 51 have been added to central paddles 52 that are mounted on arms 33A affixed to shaft 33. Paddles 51 provide improved mixing of the mortar in drum 11. The mixing paddles 51 include a radially outermost edge and a radially innermost edge joined at each of two opposite end portions of the mixing paddles by a generally linear surface. The generally linear surfaces at the opposite end portions are slanted or angled inwardly toward the shaft 33 and toward each other to create a Venturi effect which operates to force air into the mix as the central paddles are rotated. The increased quantity of entrained air makes the mix creamier and actually lowers the temperature of the mixed mortar by 5 degrees F. or more. This result provides better spreadability and proven longer board life which provides more time before coarse tooling is required. Paddles 51 are displaced endwise with respect to each other wherein each such additional paddle includes opposite end portions, each end of said end portions being angled toward each other with respect to the shaft to avoid pushing exactly the same mortar and thus improve mixing.

Standard loop latches 54, 55 and associated posts 56, 57; 58,59; connect cab sections 14 and 16 together and connect section 16 to frame 17 and are used to secure front section 16 in the down closed position as understood in the art (FIGS. 1, 2).

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A portable mortar mixing drum assembly comprising a frame, a mixing drum having a lower hollow substantially cylindrical body with an upper enlarged outlet opening covered by a pivotally mounted grate, said drum including a pair of spaced end walls and a laterally disposed discharge chute extending from said outlet opening and a back wall spaced away from said chute and integral with and extending upwardly from said body, a shaft mounted medially between said end walls and carrying a pair of oppositely disposed arms each carrying a center paddle and a mixing paddle, said arms being medially located on said shaft, each of said mixing paddles including a radially outermost edge and a radially innermost edge joined at each of two opposite end portions of said mixing paddles by a generally linear surface, said generally linear surfaces of said opposite end portions being angled toward each other and toward said shaft for increasing air entrained in the mortar during mixing of the mortar, an engine mounted on said frame operatively connected to said shaft for rotating said shaft, starter operating controls located closely adjacent a rearward portion of said engine for the safe operation thereof, and said back wall of said body being inclined from the vertical by no more than 15° to inhibit build up of the mortar being mixed in said drum.

2. The assembly as defined in claim 1 further including a bag splitter affixed to said grate located in the widest area of said outlet opening, said splitter including at least one vertically extending sharpened splitting member for penetrating a center portion of a bag carrying a mortar component to create an opening therein to cause the release of the contents thereof through said grate into said drum.

3. The assembly as defined in claim 2 wherein said splitter further includes a spaced pair of sharpened second splitting members, said second members located on opposite sides of said at least one splitting member for increasing the size of the opening in a bag created by said at least one splitting member.

4. The assembly as defined in claim 3 wherein said bag splitter is located on said grate vertically above said shaft to provide that all mortar component in a bag is deposited in said drum.

5. The assembly as defined in claim 1 further including a cab mounted on said frame for substantially enclosing said engine, said cab including a first immovable section affixed to said frame, a second section movably attached to said first section and movable between a first position covering said engine and a second position exposing said rearward portion of said engine, said second section including a front open face and a rear face having an access opening in a lower portion thereof for access to said starter operating controls of said engine when said second section of said cab is in said first position.

6. The assembly as defined in claim 5 wherein said second section includes an exhaust vent to provide passage from said cab for exhaust from said engine.

7. The assembly as defined in claim 6 wherein said discharge chute is located on one side of said assembly and said exhaust vents are located on another side of said assembly.

8. The assembly as defined in claim 5 wherein said rear face includes at least one vent above said access opening for directing engine exhaust rearwardly out of said cab.

9. The assembly as defined in claim 5 further including a generally planar member removably affixed to said cab first section to substantially shield drive components from said engine to said shaft.

10. The assembly as defined in claim 1 further including a pair of spaced V-shaped mixing paddles mounted on respective said arms spaced inwardly away from respective said center mixing paddle for increasing the amount of air entrained in the mixed mortar.

11. The assembly as defined in claim 10 further including a two-part engine cab having a rear section pivotally attached to a fixed front section, said rear section including an engine exhaust vent, said rear section of said cab including an enlarged opening for access to said starter operating controls of said engine.

12. A portable mortar mixing drum assembly comprising a frame carrying a hollow mixing drum having a body with an outlet opening covered by a grate and a pair of spaced end walls and a back wall spaced away from said outlet opening extending upwardly from said body, a shaft mounted between said end walls and carrying a pair of oppositely disposed arms each carrying a first center paddle adjacent a medial point of said shaft thereof and a second paddle for increasing the quantity of entrained air in the mortar during mixing, each said second paddle having generally linear slanted ends converging toward said shaft, an engine mounted on said frame operatively connected to said shaft for rotating said shaft, starter operating controls located closely adjacent a rearward portion of said engine for the safe operation thereof, and said back wall of said body being inclined rearwardly away from said opening from the vertical by 5°-15° to inhibit build up of the mortar being mixed in said drum on said back wall, said back wall being on a back side of the assembly untended by a user.

13. The assembly as defined in claim 12 further including an engine cab mounted on said frame for substantially enclosing said engine, said cab including a first immovable section affixed to said frame, a second section hinged to said first section, said second section including an access opening in a lower portion thereof for access to said operating controls of said engine, said second section includes an exhaust vent located on said back side to provide direct passage from said cab for exhaust from said engine.

14. The assembly as defined in claim 12 further including a bag splitter affixed to said grate directly above said shaft and centrally in the widest area of said outlet opening, said splitter including three vertically extending sharpened splitting members for penetrating a bag carrying a mortar component to create an opening therein to cause the release of the contents of such bag directly into said drum.

15. The assembly as defined in claim 12 wherein said second paddles are mounted medially on respective said arm between a said first paddle and said shaft.

16. The assembly as defined in claim 12 further including a discharge chute integrally extending from said outlet opening toward a front side of said assembly.

17. The assembly as defined in claim 16 wherein said discharge chute is approximately 24 inches in width to enlarge the area of the access space into the interior of said drum.

18. The assembly as defined in claim 12 further including a cab mounted on said frame for substantially enclosing said engine, said cab including a first immovable section affixed to said frame, a second section movably attached to said first section and movable between a first position covering said engine and a second position exposing said rearward portion of said engine, said second section including a front open face and a rear face having an access opening in a lower portion thereof for access to said starter operating controls of said engine when said second section of said cab is in said first position, a generally planar member is removably affixed to said cab first section to substantially shield drive components from said engine to said shaft.

19. A portable mortar mixing drum assembly comprising:

a frame;

a mixing drum in which said mortar is mixed, said drum being supported by said frame and having a lower, hollow substantially cylindrical body with an upper enlarged outlet opening covered by a pivotally mounted grate, a pair of spaced end walls, a laterally disposed discharge chute extending from said outlet opening, and a back wall spaced away from said chute and integral with and extending upwardly from said body, said back wall being inclined rearwardly from a vertical plane by no more than 15° so as to inhibit accumulation of mortar; and a shaft located medially between said end walls and having a pair of oppositely disposed arms each having a center paddle and a mixing paddle, said arms being medially located on said shaft, each of said mixing paddles including a radially outermost edge and a radially innermost edge joined at each of two opposite end portions of said mixing paddles by a generally linear surface, said generally linear surfaces of said opposite end portions being angled toward each other and toward said shaft to increase entrainment of air in said mixed mortar.

20. The assembly according to claim 19, wherein said back wall is inclined from 5° to 15°.

* * * * *